US010174595B2

(12) United States Patent
Knight et al.

(10) Patent No.: US 10,174,595 B2
(45) Date of Patent: Jan. 8, 2019

(54) PERFORATING TOOL

(71) Applicant: G&H Diversified Manufacturing LP, Houston, TX (US)

(72) Inventors: Benjamin Vascal Knight, Katy, TX (US); Brian Marshall Auer, Katy, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 110 days.

(21) Appl. No.: 14/921,686

(22) Filed: Oct. 23, 2015

(65) Prior Publication Data

US 2017/0115102 A1 Apr. 27, 2017

(51) Int. Cl.

| | |
|---|---|
| ***E21B 43/116*** | (2006.01) |
| ***E21B 43/117*** | (2006.01) |
| ***E21B 43/1185*** | (2006.01) |
| ***F42B 5/00*** | (2006.01) |
| ***F42D 1/00*** | (2006.01) |

(52) U.S. Cl.

CPC ..... *E21B 43/117* (2013.01); *E21B 43/1185* (2013.01); *F42B 5/00* (2013.01); *F42D 1/00* (2013.01)

(58) Field of Classification Search

CPC ..... E21B 43/116; E21B 43/117; E21B 43/119
See application file for complete search history.

(56) References Cited

U.S. PATENT DOCUMENTS

| | | | | |
|---|---|---|---|---|
| 6,354,219 | B1 * | 3/2002 | Pratt | E21B 43/117 102/306 |
| 9,903,185 | B2 * | 2/2018 | Ursi | E21B 43/119 |
| 2003/0047358 | A1 * | 3/2003 | Bonkowski | E21B 43/116 175/4.6 |
| 2007/0084336 | A1 * | 4/2007 | Neves | E21B 43/119 89/1.3 |
| 2009/0242198 | A1 * | 10/2009 | Evans | E21B 43/119 166/250.01 |
| 2016/0273281 | A1 * | 9/2016 | Bell | E21B 17/1078 |
| 2017/0268317 | A1 * | 9/2017 | Von Kaenel | E21B 43/116 |

FOREIGN PATENT DOCUMENTS

| | | | | |
|---|---|---|---|---|
| WO | WO-2016039734 | A1 * | 3/2016 | E21B 43/116 |

* cited by examiner

*Primary Examiner* — Gabriel J. Klein
(74) *Attorney, Agent, or Firm* — Conley Rose, P.C.

(57) ABSTRACT

A charge tube for use with a perforating tool that includes a tubular member having a first end, a second end, an outer surface, and a passage extending between the first end and the second end, and a receptacle extending through the outer surface of the tubular member for receiving a shaped charge, wherein the tubular member includes a reduced diameter section, and a first expanded diameter section disposed at the first end of the tubular member, the first expanded diameter section having a greater diameter than the reduced diameter section, and wherein the reduced diameter section and the first expanded diameter section of the tubular member are monolithically formed.

8 Claims, 7 Drawing Sheets

PERFORATING TOOL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

Following the casing of the wellbore, the casing string may be perforated using a perforating tool or gun to provide for fluid communication between the wellbore and the formation at desired locations. In some applications, one or more perforating guns, where each perforating gun comprises one or more shaped explosive charges, are run into the wellbore to a desired depth and fired to perforate the casing. Any remaining or unfired perforating guns may be displaced through the wellbore to different desired depths to further perforate the casing at a plurality of predetermined depths. In some applications, the perforating guns are conveyed into the wellbore via wireline, while in tubing-conveyed perforating (TCP) applications the perforating guns are conveyed using a tube. In some applications, each perforating gun comprises a tubular hollow carrier with a charge tube disposed therein, wherein the charge tube houses the one or more shaped charges of the perforating gun.

SUMMARY

An embodiment of a charge tube for use with a perforating tool comprises a tubular member having a first end, a second end, an outer surface, and a passage extending between the first end and the second end, and a receptacle extending through the outer surface of the tubular member for receiving a shaped charge, wherein the tubular member comprises a reduced diameter section, and a first expanded diameter section disposed at the first end of the tubular member, the first expanded diameter section having a greater diameter than the reduced diameter section, and wherein the reduced diameter section and the first expanded diameter section of the tubular member are monolithically formed. In an embodiment, the charge tube comprises a second expanded diameter section disposed at the second end thereof, the second expanded diameter section having a greater diameter than the diameter of the reduced diameter section, and wherein the second expanded diameter section and the reduced diameter section are monolithically formed. In an embodiment, the charge tube further comprises an outer housing, wherein the charge tube is disposed within a throughbore of the outer housing. In some embodiments, the first expanded diameter section comprises a key extending radially from the outer surface of the charge tube, and wherein the key is configured to be received within a groove of the outer housing to restrict relative rotation between the charge tube and the outer housing. In some embodiments, the charge tube further comprises a stress riser extending through the charge tube. In an embodiment, the stress riser comprises a perforation extending radially through the outer surface of the charge tube. In an embodiment, the stress riser is configured to shear the receptacle extending through the outer surface of the tubular member. In some embodiments, the first expanded diameter section and the second expanded diameter expansion are configured to radially centralize the charge tube within a throughbore of an outer housing.

An embodiment of a perforating tool comprises an outer housing having a first end, a second end, an outer surface, and a passage extending between the first end and the second end, a tubular member disposed in the outer housing, the tubular member having a first end, a second end, an outer surface, and a passage extending between the first end and the second end, and a receptacle extending through the outer surface of the tubular member for receiving a shaped charge, wherein the outer housing comprises an indentation extending into the outer surface of the outer housing, and wherein the indentation is circumferentially aligned with the receptacle of the tubular member, wherein the tubular member comprises a reduced diameter section, and a first expanded diameter section disposed at the first end of the tubular member, the first expanded diameter section having a greater diameter than the reduced diameter section, and wherein the interface between the reduced diameter section and the first expanded diameter section is jointless. In an embodiment, the reduced diameter section and the first expanded diameter section of the tubular member are monolithically formed. In an embodiment, the charge tube comprises a second expanded diameter section disposed at the second end thereof, the second expanded diameter section having a greater diameter than the diameter of the reduced diameter section, and wherein the interface between the reduced diameter section and the second expanded diameter section is jointless. In some embodiments, the first expanded diameter section comprises a key extending radially from the outer surface of the charge tube, and wherein the key is configured to be received within a groove of the outer housing to restrict relative rotation between the charge tube and the outer housing. In some embodiments, the perforating tool further comprises a stress riser extending through the charge tube. In an embodiment, the stress riser comprises a perforation extending radially through the outer surface of the charge tube. In an embodiment, the stress riser is configured to shear the receptacle extending through the outer surface of the tubular member. In some embodiments, the first expanded diameter section and the second expanded diameter expansion are configured to radially centralize the charge tube within a throughbore of an outer housing.

An embodiment of a method of forming a charge tube for use with a perforating tool comprises (a) forming a charge tube having a first end, a second end, a passage extending between the first end and the second end, an inner surface, and an outer surface, (b) cutting radially into the outer surface of the charge tube to form an aperture in the charge tube for receiving a shaped charge, and (c) radially expanding the diameter of the first end of the charge tube. In an embodiment, (c) comprises inserting a die into the passage of the charge tube, and forcibly radially expanding the first end of the charge tube using the die. In an embodiment, the method further comprises (d) fragmenting the charge tube in response to the detonation of a shaped charge disposed in the charge tube along a stress riser extending through the charge tube. In some embodiments, the method further comprises (d) rotationally orienting the charge tube in an outer housing by inserting a key of the charge tube into a groove of the outer housing.

BRIEF DESCRIPTION OF THE DRAWINGS

For a detailed description of the preferred embodiments of the disclosure, reference will now be made to the accompanying drawings in which.

DETAILED DESCRIPTION

Figure 1:
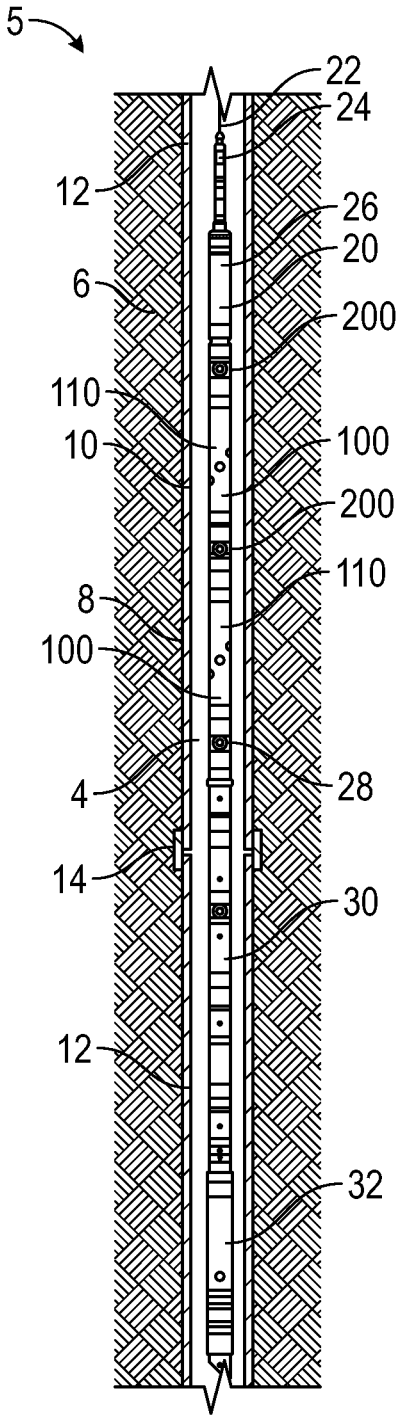
FIG. 1 is a schematic, partial cross-sectional view of a system for completing a subterranean well including an embodiment of a perforating gun assembly in accordance with the principles disclosed herein.
Figure 2:
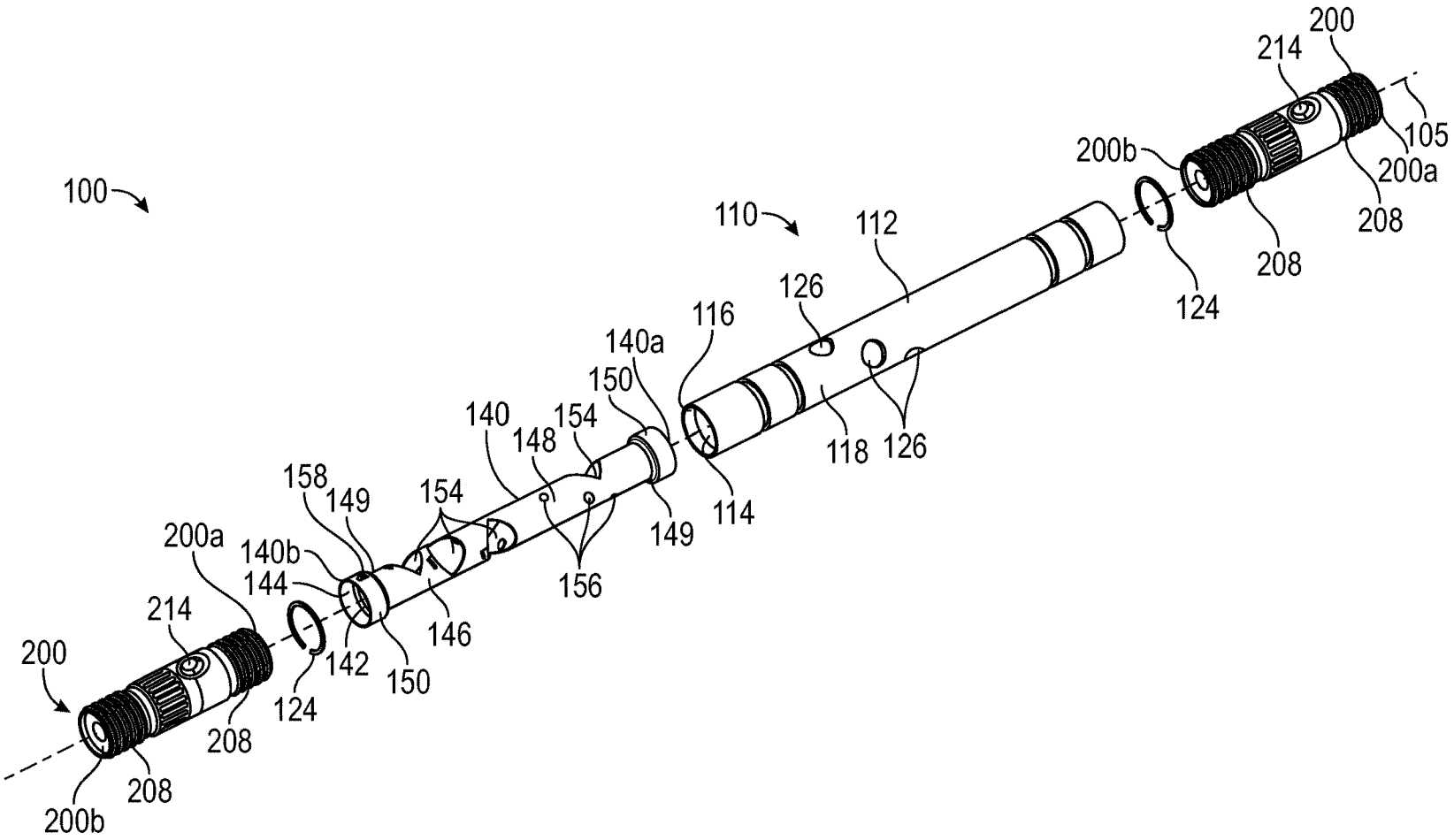
FIG. 2 is an exploded perspective view of an embodiment of a perforating gun assembly of the well system of FIG. 1.
Figure 3:
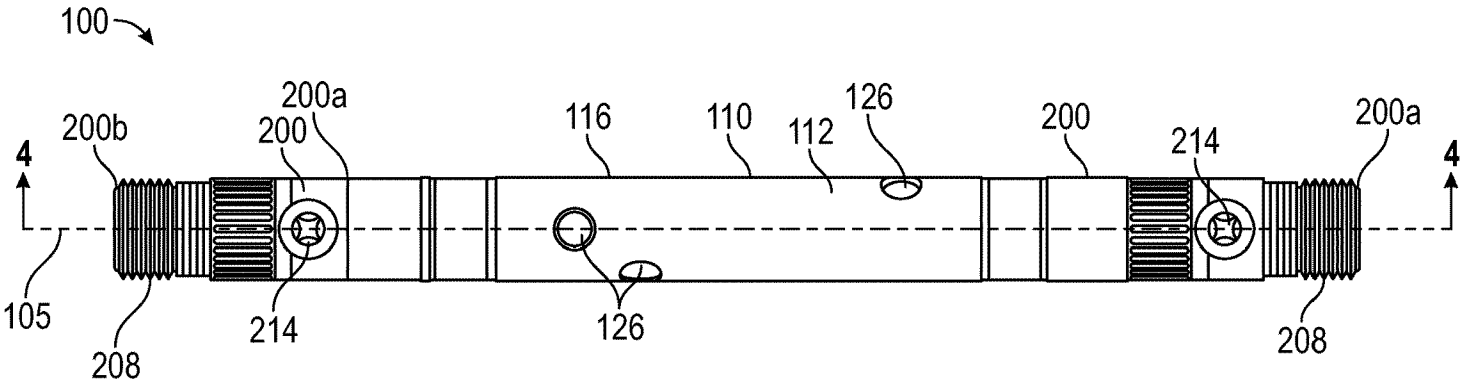
FIG. 3 is a side view of the perforating gun assembly of FIG. 2.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, FIGS. 2-8 are orientated such that the uppermost end corresponds with the rightmost end of the Figure while the lowermost end corresponds with the leftmost end of the Figure. Also, the term "fluid," as used herein, is intended to encompass both fluids and gasses.

Referring now to FIG. 1, a system 5 for completing a wellbore 4 extending into a subterranean formation 6 is shown. In the embodiment of FIG. 1, wellbore 4 is a cased wellbore including a casing string 10 secured to an inner surface 8 of the wellbore 4 using cement (not shown). Casing string 10 generally includes a plurality of tubular segments 12 coupled together via a casing collar 14. In this embodiment, system 5 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 5 may further include suitable surface equipment (not shown) for drilling, completing, and/or operating system 5 and may include, in some embodiments, derricks, structures, pumps, electrical/mechanical well control components, etc. Tool string 20 is generally configured to perforate casing string 10 to provide for fluid communication between formation 6 and wellbore 4 at predetermined locations.

In the embodiment shown in FIG. 1, tool string 20 generally includes a cable head 24, a casing collar locator (CCL) 26, perforating gun assemblies 100, a plug-shoot firing head 28, a setting tool 30, and a plug 32. Cable head 24 is the uppermost component of tool string 20 and includes an electrical connector for providing electrical signal and power communication between the wireline 22 and the other components (CCL 26, perforating gun assemblies 100, etc.) of tool string 20. CCL 26 is coupled to a lower end of the cable head 24 and is generally configured to transmit an electrical signal to the surface via wireline 22 when CCL 26 passes through casing collar 14, where the transmitted signal may be recorded at the surface as a collar kick, as discussed above, to determine the position of tool string 20 within wellbore 4 by correlating the recorded collar kick with an open hole log.

Perforating gun assemblies 100 of tool string 20 are coupled to CCL 100 and are generally configured to perforate casing string 10 and provide for fluid communication between formation 6 and wellbore 4. In an embodiment, perforating gun assemblies 100 are coupled to CCL 26 via a direct connect sub. In this embodiment, each perforating gun assembly 100 comprises a perforating tool 110 and one or more switch subs 200. In this arrangement, a switch sub 200 is disposed between succeeding pairs of perforating tools 110. As will be explained further herein, perforating gun assemblies 100 include a plurality of shaped charges that may be detonated by a signal conveyed by the wireline 22 to produce an explosive jet directed against casing string 10.

As will be explained further herein, the switch subs 200 of perforating gun assemblies 100 include an electrical conductor and switch generally configured to allow for the passage of an electrical signal to the lowermost perforating tool 110 of tool string 20. Tool string 20 further includes plug-shoot firing head 28 coupled to a lower end of the lowermost perforating gun assembly 100. Plug-shoot firing head 28 couples the perforating gun assemblies 100 of the tool string 20 to the setting tool 30 and plug 32, and is generally configured to pass a signal from the wireline 22 to the setting tool 34 of tool string 20. Plug-shoot firing head 28 may also include mechanical and/or electrical components to fire the setting tool 30.

In the embodiment shown in FIG. 1, tool string 20 further includes setting tool 30 and plug 32, where setting tool 30 is coupled to a lower end of plug-shoot firing head 32 and is generally configured to set or install plug 32 within casing string 10 to isolate desired segments of the wellbore 4. Once plug 32 has been set by setting tool 30, an outer surface of plug 32 seals against an inner surface of casing string 10 to restrict fluid communication through wellbore 4 across plug 32. Setting tool 30 of tool string 20 may be any suitable setting tool known in the art while still complying with the principles disclosed herein. Although CCL 100 is shown in FIG. 1 as incorporated in tool string 20, CCL 100 may be used in other tool strings comprising components differing from the components comprising tool string 20. While in the embodiment of FIG. 1 perforating gun assemblies 100 are shown as part of wireline tool string 20, in other embodiments perforating gun assemblies 100 may be conveyed through wellbore 4 on a tube as part of a tubing-conveyed perforating (TCP) application.

Referring to FIGS. 2-5, in this embodiment perforating tool 110 has a central or longitudinal axis 105 and generally includes a cylindrical outer housing or carrier 112 and an inner cylindrical tubular member or charge tube 140 disposed therein. Carrier 112 of perforating tool 110 is configured to receive and house the charge tube 140, and retains debris after the perforating tool 110 is fired. Carrier 112 is disposed coaxially with longitudinal axis 105 and has a first or upper end 112*a*, a second or lower end 112*b*, a throughbore or passage 114 extending between ends 112*a* and 112*b* and defined by a generally cylindrical inner surface 116, and a generally cylindrical outer surface 118. The inner surface 116 of carrier 112 at upper end 112*b* and lower end 112*b* includes a threaded connector 120 for threadably connecting with an adjoining switch sub 200. In this embodiment, the inner surface 116 also includes a pair of annular grooves 122 extending therein and disposed proximal the upper end 112*a* and the lower end 112*b*, where each annular groove 122 is configured to receive an annular snap ring 124 for coupling the charge tube 140 to the carrier 112. However, in certain embodiments, carrier 112 does not include annular grooves 122 and perforating tool 110 does not include snap rings 124 for coupling charge tube 140 to carrier 112. In these embodiments, other mechanisms may be utilized for restricting axial and/or rotational movement of charge tube 140 relative carrier 112.

In this embodiment, carrier 112 includes a plurality of axially and circumferentially spaced indentations or scallops 126 that extend partially into outer surface 118. Scallops 126 form thin-walled, frangible sections in carrier 112 configured to break apart upon the firing of a corresponding shaped charge 316 (shown in FIG. 5) received in the charge tube 140. In this arrangement, each scallop 126 of carrier 112 is axially and circumferentially aligned with a corresponding shaped charge 316, such that when perforating tool 110 is fired or detonated each shaped charge 316 displaces a high velocity jet of particles through a corresponding scallop 126 of carrier 112 to form perforations in casing string 10. In this embodiment, scallops include an approximately 60° circumferential offset or phasing; however, in other embodiments, the phasing of scallops 126 may vary. Moreover, in certain embodiments, carrier 112 may include only a single scallop 126. In further embodiments, carrier 112 may not include scallops 126. In this embodiment, carrier 112 includes an axially extending groove 128 disposed in inner surface 116, where groove 128 is configured to receive a mating key of the charge tube 140, as will be discussed further herein.

In this embodiment, perforating tool 110 is flanked by a pair of switch subs 200. As will be discussed further herein, switch subs 200 are configured to pass signals between the multiple perforating tools 110 of tool string 20 and to control the detonation of the shaped charges 316 housed in each perforating tool 110. In this embodiment, each switch sub 200 is disposed coaxially with longitudinal axis 105 and has a first or upper end 200*a*, a second or lower end 200*b*, a throughbore 202 extending between ends 200*a* and 200*b* and defined by a generally cylindrical inner surface 204, and a generally cylindrical outer surface 206. Each end 200*a* and 200*b* of switch sub 200 includes a threaded connector 208 disposed on the outer surface 206 thereof. Switch sub 200 also includes a pair of annular seals 210 disposed proximal each end 200*a* and 200*b*, and extending radially into outer surface 206. As shown particularly in FIG. 4, the threaded connectors 208 of switch subs 200 are configured to threadably couple with a corresponding threaded connector 120 of carrier 120, and annular seals 210 of switch subs 200 are configured to sealingly engage the inner surface 116 of carrier 112 to restrict fluid communication between the wellbore 4 and the throughbore 114 of carrier 112.

In this embodiment, each switch sub 200 includes a radially extending access port 212 having a removeable plug 214 received therein. An annular seal 216 is disposed between plug 214 and an inner surface of access port 212 to seal throughbore 202 of switch sub 200 from the wellbore 4. Access port 212 is generally configured to provide access to one or more components disposed within the throughbore 202 of switch sub 200, as will be discussed further herein. Also, in this embodiment, the throughbore 202 of each switch sub 200 includes a first or detonator chamber 202*a* disposed proximal upper end 200*a*, and a second or switch chamber 202*b* disposed proximal lower end 200*b*, where detonator chamber 202*a* is configured to house a detonator for firing the shaped charges 316 of perforating tool 110 and switch chamber 202*b* is configured to house a pressure switch for controlling the passage of signals to the detonator and other perforating gun assemblies 100 of tool string 20.

Charge tube 140 is disposed within the throughbore 114 of carrier 112 and is configured to house the shaped charges 316 and detonating cord 314 (shown in FIG. 5) of perforating tool 110. In this embodiment, charge tube 140 is disposed coaxially with longitudinal axis 105 and has a first or upper end 140*a*, a second or lower end 140*b*, a throughbore or passage 142 extending between ends 140*a* and 140*b* and defined by a generally cylindrical inner surface 144, and a generally cylindrical outer surface 146. While in this embodiment charge tube 140 is generally cylindrical in shape, having a generally circular lateral cross-section, in other embodiments charge tube 140 may comprise other shapes, such as shapes including rectangular lateral cross-sections.

In this embodiment, charge tube 140 includes a reduced diameter section 148 extending axially between a pair of expanded diameter sections 150, with one expanded diameter section 150 disposed at each end 140*a* and 140*b* of charge tube 140. Particularly, the outer surface 146 of expanded diameter sections 150 has a diameter $D_1$ that is greater than a diameter $D_2$ of the outer surface 146 of reduced diameter section 148. In this arrangement, an annular gap 152 extends radially between the outer surface 146 of reduced diameter section 148 and the inner surface 116 of carrier 112, while the outer surface 146 of expanded diameter sections 150 is disposed directly adjacent the inner surface 116 of carrier 112. In this manner, expanded diameter sections 150 are configured to radially and/or angularly centralize charge tube 140 within carrier 112. In other words, because the diameter $D_1$ of the outer surface of expanded diameter sections 150 is approximately or substantially the same as the diameter of the inner surface of the carrier 112, charge tube 140 is radially and/or angularly centralized within the throughbore 114 of carrier 112 such that annular gap 152 is substantially consistent across the circumference of charge tube 140. Annular gap 152 may be predetermined or tuned for the particular application in which perforating tool 110 is utilized. In certain embodiments, the outer surface 146 of expanded diameter sections 150 slidingly engages the inner surface 116 of carrier 112.

In this embodiment, reduced diameter section 148 and expanded diameter sections 150 are formed monolithically or integrally with each other to form a single, monolithically formed, and unitary charge tube 140. As used herein, the term monolithic or monolithically formed is defined as being formed from or cast from a single piece. In other words, there are no joints, fasteners, or other mechanisms coupling reduced diameter section 148 with expanded diameter sections 150, and instead, reduced diameter section 148 and expanded diameter sections 150 comprise or form a unitary, integral charge tube 140. In this embodiment, an interface 149 between the reduced diameter section 148 and the expanded diameter sections 150 is jointless and/or seamless. In certain embodiments, charge tube 140 is manufactured from steel tubing, where expanded diameter sections 150 are formed by single or multiple die or swedge and form operations. In those embodiments, the expanded diameter sections 150 are radially expanded from the lesser or base diameter $D_1$ to the greater diameter $D_2$. In other embodiments, charge tube 140 may be formed from other metals and non-metallic materials including plastics, elastomers, cardboards, etc. In certain embodiments, a finish is applied to the outer surface 146 of charge tube 140 to provide corrosion resistance and maximize electrical conductivity. In certain embodiments, charge tube 140 comprises a plastic cast in a mold including reduced and expanded diameter sections. The unitary or integral construction of charge tube 140, which includes both reduced diameter section 148 and expanded diameter sections 150, confers several advantages. Particularly, the monolithic, and jointless construction of charge tube 140 (as opposed to comprising multiple independent components coupled together) reduces material and component costs, assembly labor costs, and inventory costs. For instance, the monolithic construction of charge tube 140 eliminates the need for additional fasteners and associated components for assembling charge tube 140, the time required for assembling charge tube 140, and the inventory costs of housing these additional components.

In this embodiment, the reduced diameter section 148 of charge tube 140 includes a plurality of charge receptacles 154 extending radially therein, where each charge receptacle 154 is configured to receive and house a corresponding shaped charge 316. Also, each charge receptacle 154 includes a pair of flexible burrs 154*a* that are flexed upon the installation of a corresponding shaped charge 316 within the charge receptacle 154 to physically engage the shaped charge 316 and couple the shaped charge 316 thereto. As with scallops 126 of carrier 112, in this embodiment, charge receptacles 154 of charge tube 140 include an approximately 60° circumferential offset or phasing; however, in other embodiments, the phasing of charge receptacles 154 may vary. Moreover, in certain embodiments, charge tube 140 may include only a single charge receptacle 154 for receiving a corresponding single shaped charge 316. In the arrangement shown particularly in FIG. 4, each charge receptacle 154 of charge tube 140 is substantially axially and circumferentially aligned with a corresponding scallop 126 of carrier 112 when perforating tool 110 is in an assembled configuration.

Charge tube 140 also includes a plurality of generally circular apertures 156 extending radially therein, where each aperture 156 is configured to receive a first or inner end 316*a* of a shaped charge 316 for connecting with a portion of a detonator cord 314 to a corresponding shaped charge 316 disposed in one of the charge receptacles 154. Particularly, each aperture 156 is substantially axially aligned and circumferentially spaced 180° from a corresponding charge receptacle 154. In this configuration, the detonator cord may couple with the inner end 316*a* (shown in FIG. 5) of the shaped charge 316 positioned proximal the aperture 156 while a second or outer end 316*b* (shown in FIG. 5) of the shaped charge 316 is positioned proximal charge receptacle 154, where the high velocity jet of particles is emitted from the outer end 316*b* of the shaped charge 316 upon detonation of the shaped charge 316.

In this embodiment, the expanded diameter section 150 disposed at the lower end 140*b* of charge tube 140 includes a key 158 that extends radially outwards from outer surface 146. In certain embodiments, key 158 is formed by drawing and concurrently shearing the material of the lower expanded diameter section 150 as a die is pressed against inner surface 144 of the expanded diameter section 150. In other embodiments, key 158 is formed via a mold where charge tube 140 comprises a plastic material. Key 158 of charge tube 140 is configured to be received within the corresponding groove 128 of carrier 112 to circumferentially align the charge tube 140 with the carrier 112. Particularly, engagement between key 158 and corresponding groove 128 is configured to circumferentially align the charge receptacles 154 of charge tube 140 with the corresponding scallops 126 of carrier 112, such that when the shaped charges 316 of perforating tool 110 are detonated the resulting high velocity jets of particles are directed against and through scallops 126 of carrier 112.

Figure 4:
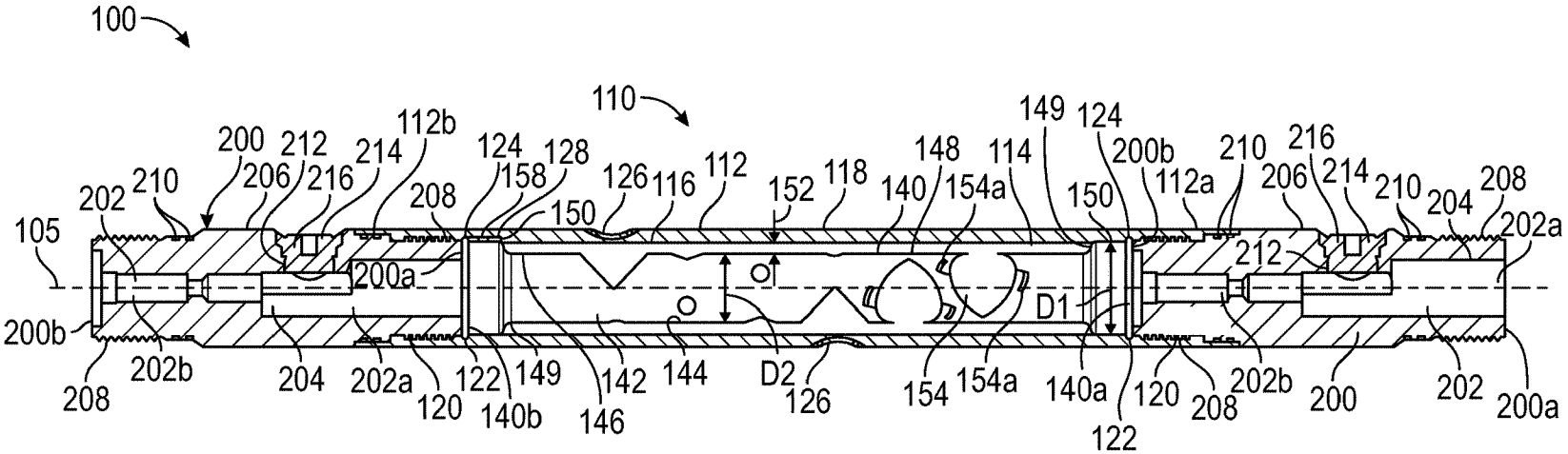
FIG. 4 is a cross-sectional along lines 4-4 of FIG. 3 of the perforating gun assembly of FIG. 2.

In this embodiment, key 158 is slidingly received within groove 128 of carrier 112. Thus, in assembling charge tube 140 and carrier 112, the upper end 140*a* of charge tube 140 may be axially inserted into the lower end 112*b* of carrier 112 and displaced axially into throughbore 114 of carrier 112 until key 158 of charge tube 140 engages an annular shoulder of the inner surface 116 of carrier 112. At this point, charge tube 140 may be rotated until key 158 circumferentially aligns with the corresponding groove 128, thereby allowing charge tube 140 to be fully axially inserted into carrier 112, as shown in FIG. 4. Although in this embodiment charge tube 140 includes key 158, in other embodiments charge tube 140 may not include key 158. For instance, in certain embodiments, charge tube 140 may comprise other members or mechanisms configured to circumferentially align charge tube 140 and carrier 112. In still further embodiments, charge tube 140 is permitted to freely rotate within carrier 112 without any predetermined circumferential orientation between charge tube 140 and carrier 112.

In this embodiment, charge tube 140 is secured to carrier 112 via snap rings 124. Particularly, snap rings 124 are received within annular grooves 122 and frictionally engage the outer surface 146 of each expanded diameter section 150 of charge tube 140 to restrict relative axial movement between charge tube 140 and carrier 112. While in this embodiment perforating tool 110 includes snap rings 124, in other embodiments perforating tool 110 does not include snap rings 124. For instance, in certain embodiments, perforating tool 110 may comprise other members or mechanisms for restricting relative axial movement between charge tube 140 and carrier 112. In still further embodiments, the upper end 200*a* and/or lower end 200*b* of the adjacent switch sub 200 coupled to carrier 112 engages a corresponding end (140*a* or 140*b*) of charge tube 140 to restrict relative axial movement between charge tube 14 and carrier 112.

Figure 6:
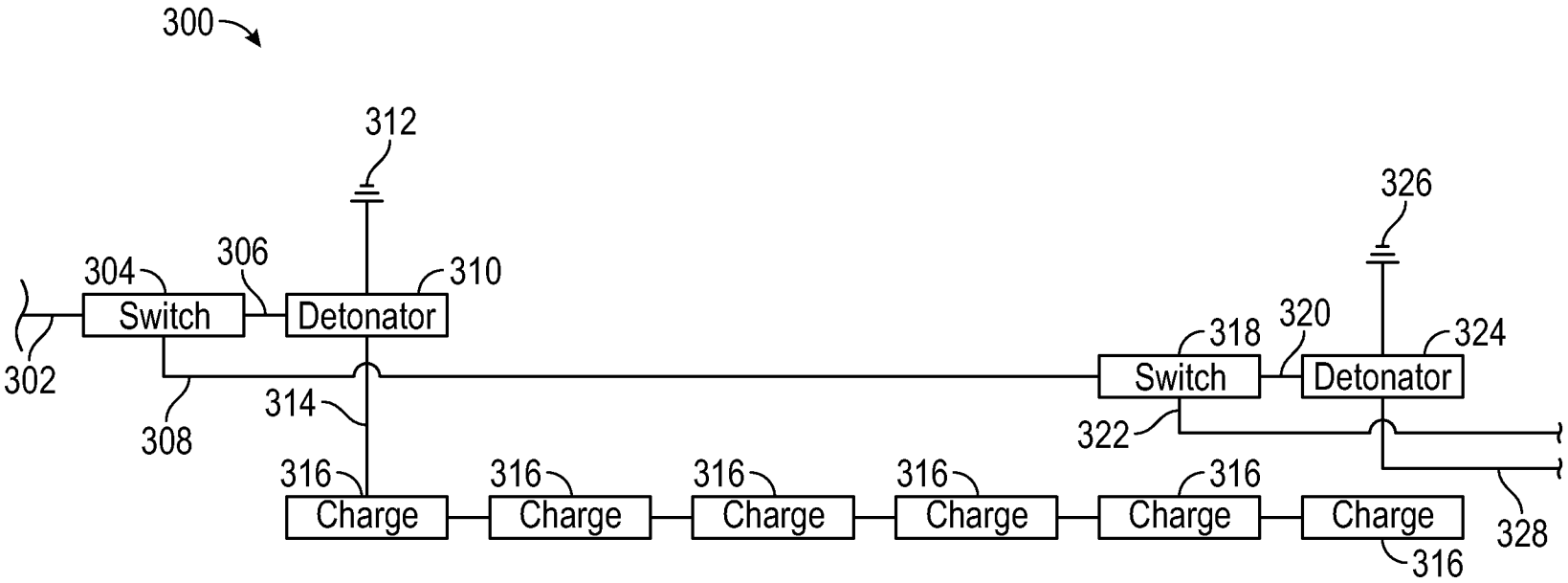
FIG. 6 is a schematic view of a detonation system of the perforating gun assembly of FIG. 2.

Referring to FIGS. 4 and 6, FIG. 6 schematically illustrates an exemplary detonation system 300 of the perforating gun assembly 100 of FIG. 4. In the embodiment shown in FIG. 6, detonation system 300 generally includes a pair of switches 304 and 318, a pair of detonators 310 and 324, and a plurality of shaped charges 316. Specifically, a cable 322 extends from the CCL 26 of tool string 20 and connects to a first or upper switch 318, which is disposed within switch chamber 202*b* of the uppermost (i.e., rightmost in FIG. 4) switch sub 200 of FIG. 4. The upper switch 318 connects to a first or upper detonator 324 disposed within detonator chamber 202*a* of the uppermost switch sub 200 via cable 320. Upper detonator 324 is grounded via grounding circuit 326 connected thereto.

In this embodiment, a cable 308 connects the upper switch 318 with a second or lower switch 304 disposed in the switch chamber 202*b* of the lowermost (i.e., leftmost shown in FIG. 4) switch sub 200 of FIG. 4. Similar to the configuration of upper switch 318, lower switch 304 is connected with a cable 306 connected to a second or lower detonator 310, and a cable 302 that connects to a lower adjacent perforating tool 110 of tool string 20. Lower detonator 310 is disposed in the detonator chamber 202*a* of the lowermost (i.e., leftmost shown in FIG. 4) switch sub 200 of FIG. 4, and is grounded via grounding circuit 326. Lower detonator 310 is connected to the plurality of shaped charges 316 via cable or detonating cord 314. As described above, each shaped charge 316 is received within a corresponding charge receptacle 154 of charge tube 140. Further, portions of detonating cord 314 extend through apertures 156 to connect detonating cord 314 to the lower end 316*a* of each shaped charge 316. Although in the embodiment of FIG. 6 detonation system 300 is shown including six shaped charges 316, in other embodiments, detonation system 300 may include varying numbers of shaped charges 316.

In this embodiment, upper switch 318 is configured to receive a signal communicated from the surface via wireline 22 and cable 322 and, in response, to transmit a signal either to the upper detonator 324 for firing shaped charges 316 or lower switch 304. Similarly, lower switch 304 is configured to receive a signal from upper switch 318 via cable 308 and, in response, transmit a signal either to lower detonator 310 or a lower adjacent perforating tool 110 via cable 302. Upper and lower detonators 324 and 310 are configured to receive a signal (e.g., electrical current, etc.) from a corresponding switch 318 and 304, respectively causing them to detonate, thereby initiating detonation of the detonating cord 328 and 314, respectively which in turn detonates the corresponding set of shaped charges 316.

In certain embodiments, switches 304 and 318 comprise pressure switches configured to utilize pressure shockwaves generated by the detonation of the shaped charges of a perforating tool 110 of tool string 20 in arming the proceeding detonator (310 or 324). In some embodiments, pressure switches 304 and 318 each include a diode to provide for selectively controlling the firing of each perforating tool 110. For instance, in this embodiment, a first perforating tool 110 of tool string 20 may be fired at a first depth in wellbore 4, and subsequently, a second perforating tool 110 of tool string 20 may be fired at a second depth in wellbore 4 (shown in FIG. 1) to provide discreet points of fluid communication between the wellbore 4 and the formation 6 at different predetermined depths. In other embodiments, switches 304 and 318 comprise dual diode switches configured to selectively actuate predetermined perforating tools 110 of tool string 20 without relying on external pressure signals, such as pressure signals from the shockwaves following the detonation of a perforating tool 110.

Figure 7:
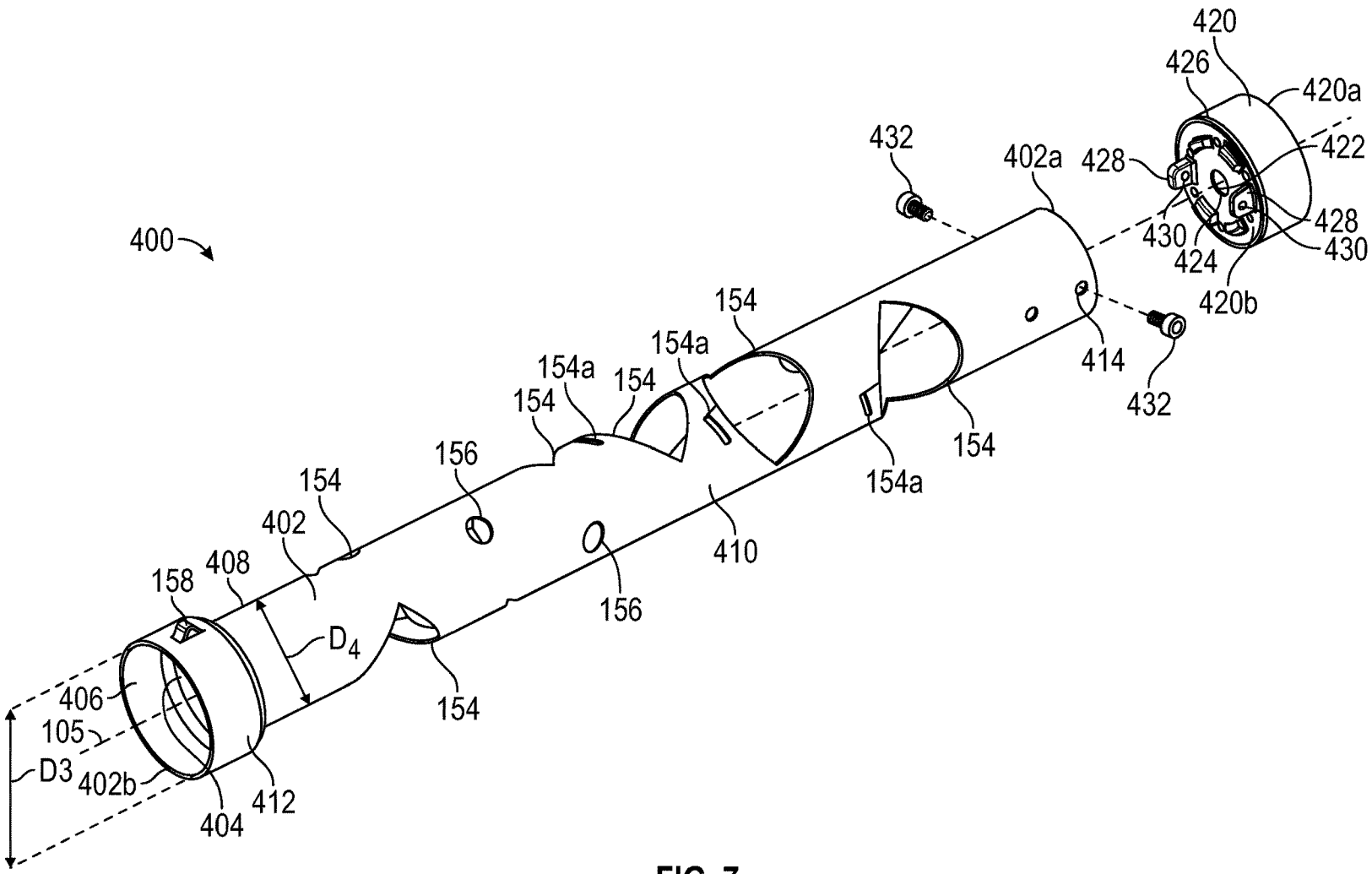
FIG. 7 is an exploded perspective view of an embodiment of a charge tube assembly for use in the perforating gun assembly of FIG. 1.

Referring to FIGS. 1 and 4-7, another embodiment of a charge tube assembly 400 is shown in FIG. 7 for use in perforating gun assembly 100 in lieu of charge tube 140 discussed above. Charge tube assembly 400 includes a generally cylindrical charge tube 402 and an annular endplate 420. Charge tube assembly 400 includes many features in common with charge tube 140, and shared features are labeled similarly. In this embodiment, charge tube 402 is disposed coaxially with longitudinal axis 105 and has a first or upper end 402*a*, a second or lower end 402*b*, a throughbore 404 extending between ends 402*a* and 402*b* and defined by a generally cylindrical inner surface 406, and a generally cylindrical outer surface 408.

In this embodiment, charge tube 402 includes a reduced diameter section 410 extending axially from upper end 402*a* to a single expanded diameter section 412 disposed at the lower end 402*b* of charge tube 402. Particularly, the outer surface 408 of expanded diameter section 412 has a diameter $D_3$ that is greater than a diameter $D_4$ of the outer surface 408 of reduced diameter section 410. Similar to the configuration of charge tube 140 discussed above, reduced diameter section 410 and expanded diameter section 412 are formed integrally with each other to form a single, unitary charge tube 402. In other words, there are no joints, fasteners, or other mechanisms coupling reduced diameter section 410 with expanded diameter section 412, and instead, reduced diameter section 410 and expanded diameter section 412 comprise or form a unitary, integral charge tube 402. In this embodiment, the reduced diameter section 412 also includes a pair of circumferentially spaced apertures 414 disposed proximal upper end 402*a*.

Unlike charge tube 140, charge tube 402 is configured to releasably couple with end plate 420 for forming charge tube assembly 400. Particularly, in this embodiment, end plate 420 is disposed coaxially with longitudinal axis 105 and has a first or upper end 420*a*, a second or lower end 420*b*, a passage 422 extending between ends 420*a* and 420*b* and defined by a generally cylindrical inner surface 424, and a generally cylindrical outer surface 426. Also, in this embodiment, end plate 420 includes a pair of circumferentially spaced tabs 428 that extend axially from lower end 420*b* of end plate 420. Each tab 428 includes a corresponding aperture 430 for receiving a fastener 432. Specifically, when tabs 428 are disposed within throughbore 404 of charge tube 402, fasteners 432 are extended through apertures 414 of charge tube 402 and received within apertures 430 of tabs 428, where each fastener 432 threadably couples with a threaded inner surface of each aperture 430, thereby coupling end plate 420 to the upper end 402*a* of charge tube 402 to form charge tube assembly 402.

The use of releasably coupled end plate 420 in lieu of an integrally formed expanded diameter section can be advantageous in particular applications. Particularly, the use of end plate 420 allows for flexibility by allowing personnel of system 5 to select an end plate having desirable features for the particular application of perforating tool 110. For instance, in this embodiment, the diameter of passage 424 is less than the diameter of the throughbore 404 of charge tube 402, thereby allowing end plate 420 to function as a baffle to restrict or muffle pressure shockwaves from detonated shaped charges disposed in charge tube 402. Particularly, the baffling effect produced by end plate 420 buffers the pressure shockwave, diminishing the shockwave as it acts upon the switch 318 (shown in FIG. 6) disposed in the switch chamber 202*b* of the uppermost switch sub 200 of FIG. 4.

Figure 8:
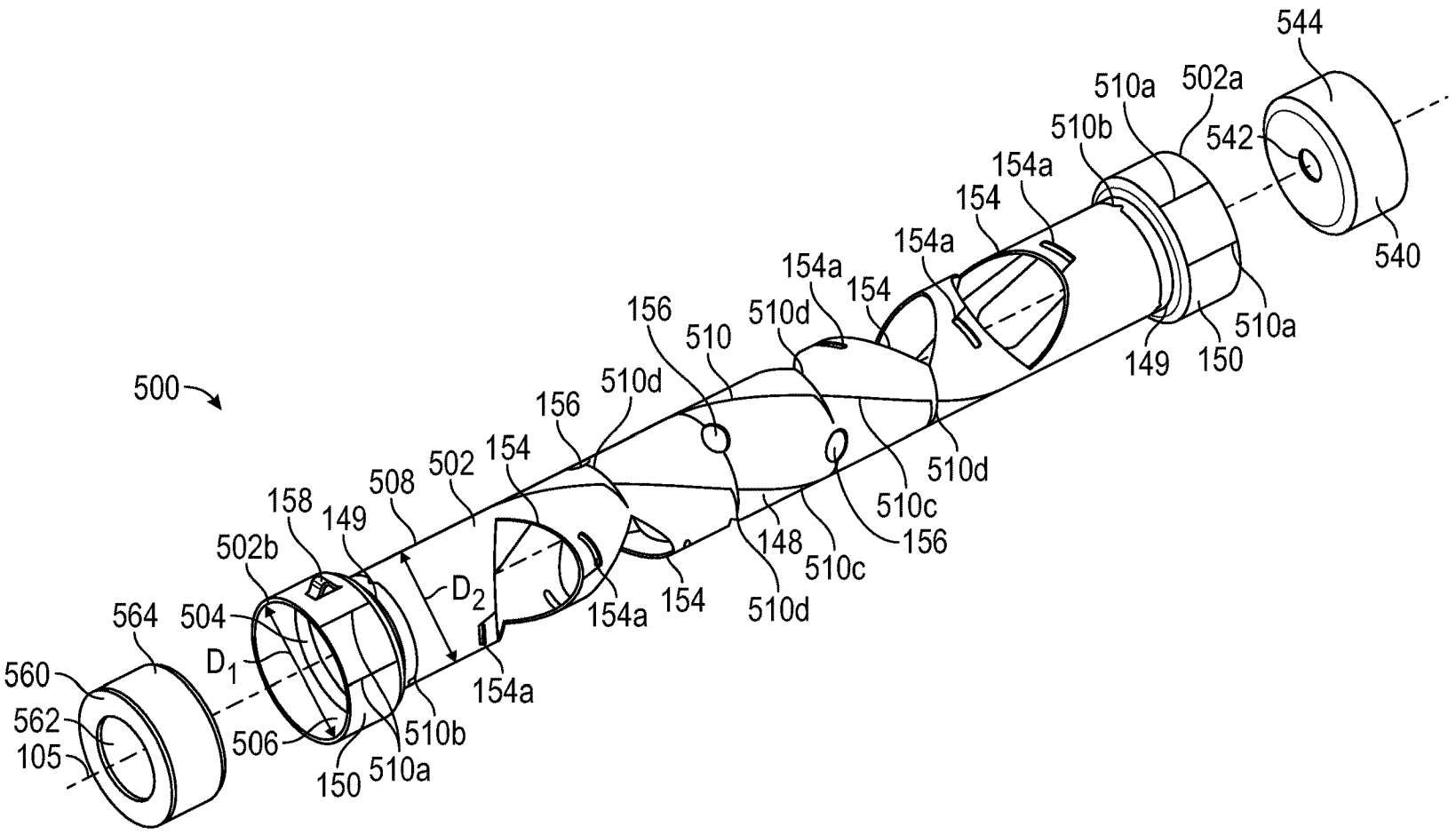
FIG. 8 is an exploded perspective view of another embodiment of a charge tube assembly for use in the perforating gun assembly of FIG. 1.

Referring to FIGS. 1, 4, 6, and 8, another embodiment of a charge tube assembly 500 is shown in FIG. 8 for use in perforating gun assembly 100 in lieu of charge tube 140 discussed above. Charge tube assembly 500 includes a generally cylindrical charge tube 502, a first or upper annular baffle 540, and a second or lower annular baffle 560. Charge tube assembly 500 includes many features in common with charge tube 140, and shared features are labeled similarly. In this embodiment, charge tube 502 is disposed coaxially with longitudinal axis 105 and has a first or upper end 502*a*, a second or lower end 502*b*, a throughbore 504 extending between ends 502*a* and 502*b* and defined by a generally cylindrical inner surface 506, and a generally cylindrical outer surface 508. As with charge tube 402 discussed above, charge tube 502 includes reduced diameter section 148 and expanded diameter sections 150, where expanded diameter sections 150 are integrally formed with reduced diameter section 148.

Figure 5:
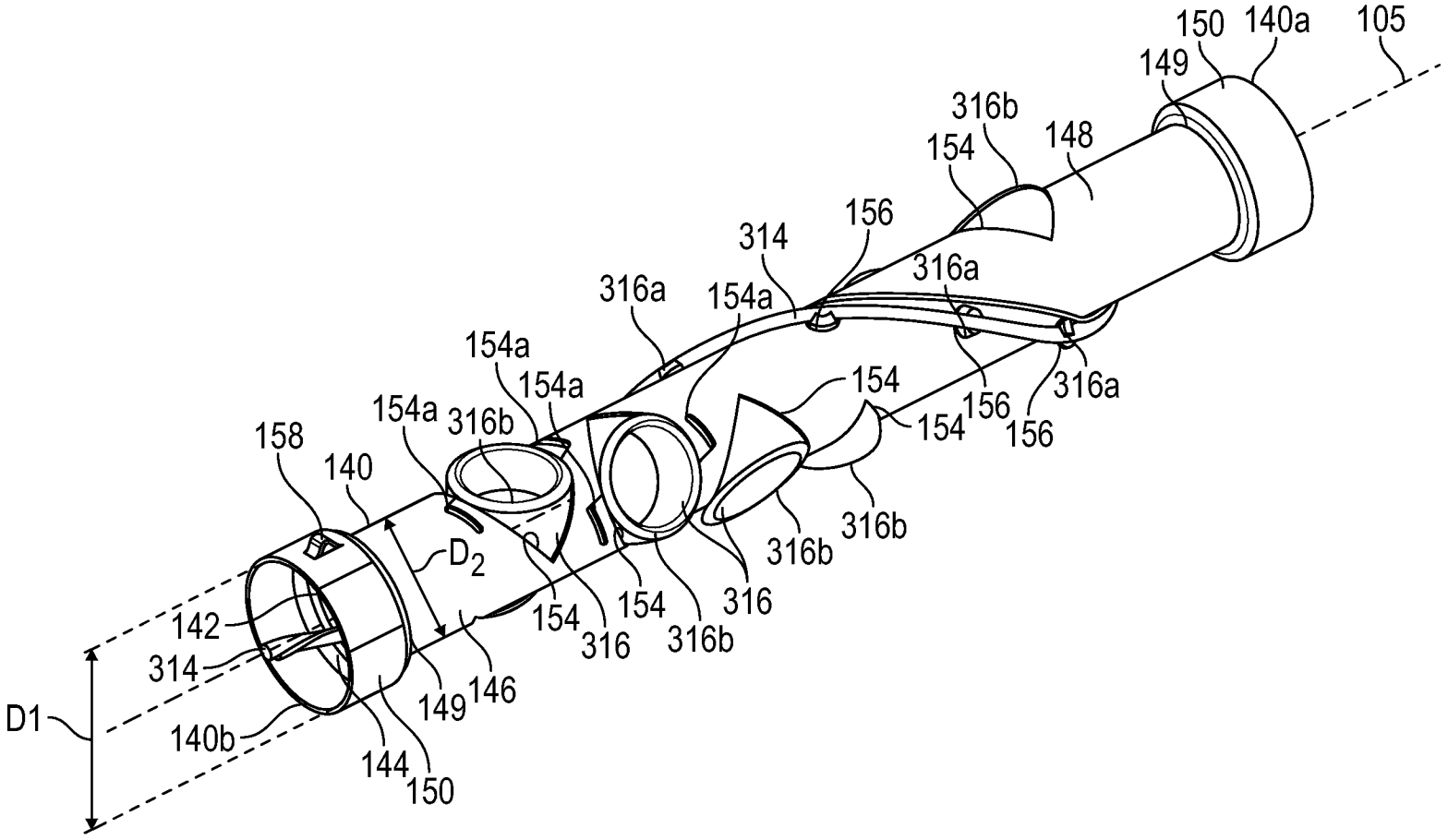
FIG. 5 is a perspective view of an embodiment of a charge tube of the perforating gun assembly of FIG. 2.

In this embodiment, charge tube 502 includes a plurality of stress risers 510 configured to fragment charge tube 502 into relatively small pieces of debris following the detonation of shaped charges 316 (shown schematically in FIG. 5). Particularly, in response to detonation of shaped charges 316, stress risers 510, which act as stress concentrators, shear or break apart therealong, thereby breaking or fragmenting charge tube 502 into small fragments. In this manner, stress risers 510 aid in fragmenting charge tube 502 following the detonation of shaped charges 316 by serving as stress concentrators configured to shear therealong in response to the detonation of charges 316. For instance, in certain embodiments, stress risers 510 cause charge tube 502 to fragment into relatively smaller fragments following the detonation of shaped charges 316 than charge tube 502 would have without stress risers 510. In other words, in certain embodiments, stress risers 510 decrease the size (e.g., the average or median size) of debris or fragments of charge tube 502 following the detonation of shaped charges 316. In certain embodiments, decreasing the size of fragments of charge tube 502 following the detonation of shaped charges 316 confers the advantage of more convenient and effective disposal of carrier 112 and perforating gun assembly 100 following a perforating operation utilizing perforating gun assembly 100 such that carrier 112, and other components of perforating gun assembly 100, may be separated, inspected, and disposed. In certain embodiments, the fragmentation caused by stress risers 510 also mitigates the possibility of damaging carrier 112 following the detonation of shaped chargers 316.

In this embodiment, stress risers 510 of charge tube 502 include circumferentially spaced and axially extending stress risers 510*a* disposed in expanded diameter sections 510 configured to fragment expanded diameter sections 510 in response to the detonation of shaped charges 316. Stress risers 510 also include a pair of circumferentially extending or annular stress risers 510*b* axially disposed at the terminal ends of reduced diameter section 148. Stress risers 510 further include a plurality of helical stress risers 510*c* extending axially and circumferentially along reduced diameter section 148, and configured to shear and tear apart reduced diameter section 148 in response to the detonation of shaped charges 136. In this embodiment, helical stress risers 510*c* include a plurality of circumferentially extending burrs or stress risers 510*d*. Circumferential stress risers 510*d* are configured to shear circumferentially and are axially positioned adjacent apertures 156 and charge receptacles 154 such that apertures 156 and charge receptacles 154 are sheared or torn apart in response to the detonation of shaped charges 136.

While in this embodiment stress risers 510 comprise the geometries of stress risers 510*a*-510*d* as described above, in other embodiments, stress risers 510 may comprise varying geometries and may extend through charge tube 502 in various patterns. Further, in this embodiment, stress risers 510 discussed above comprise perforations in charge tube 502. However, in other embodiments, stress risers 510 may comprise indentations, areas of reduced cross-section, prestressed areas, or other features configured to act as a point of failure or relative weakness in charge tube 502.

In this embodiment, charge tube assembly 500 also includes baffles 540 and 560, each of which are configured to muffle or restrict the passage of the pressure shockwave created by the detonation of shaped charges 316 from propagating to the adjoining switch subs 200 of perforating gun assembly 100. In this manner, the pressure acting upon switches 304 and 318 (shown in FIG. 5) from the pressure shockwave created by the detonation of shaped charges 316 is reduced by the muffling functionality provided by baffles 540 and 560. Further, baffles 540 and 560 are also configured to facilitate the use of adapters and other components utilized in TCP applications. Thus, in this embodiment, charge tube assembly 500 may be utilized in TCP applications.

Upper baffle 540 is disposed coaxially with longitudinal axis 105 and includes a passage 542 and an outer surface 544. Similarly, lower baffle 560 is disposed coaxially with longitudinal axis 105 and includes a passage 562 and an outer surface 564. In this embodiment, passage 542 of upper baffle 540 has a lesser diameter than the diameter of the passage 562 of lower baffle 560. In this configuration, upper baffle 540 provides a relatively greater baffling or muffling effect on pressure shockwaves than lower baffle 560. However, in other embodiments, upper baffle 540 may include a passage 542 having a larger diameter than the diameter of passage 562 of lower baffle 560, or, in still further embodiments, baffles 540 and 560 may include passages 542 and 562, respectively, having similar diameters. In this embodiment, upper baffle 540 is installed within the expanded diameter section 150 disposed at the upper end 502*a* of charge tube 502 and lower baffle 560 is installed within the expanded diameter section 150 disposed at lower end 502*b*. In this arrangement, the outer surface 544 of upper baffle 540 and the outer surface 564 of lower baffle 560 are each disposed directly adjacent the inner surface 506 of charge tube 502. In certain embodiments, baffles 540 and 560 are press fit within expanded diameter sections 150. However, in other embodiments, baffles 540 and 560 may be slidably disposed within expanded diameter sections 150, or secured to expanded diameter sections 150 in other ways.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating tool, comprising:

an outer housing having a first end, a second end, an outer surface, and a passage extending between the first end and the second end;

a tubular member disposed in the outer housing, the tubular member having a first end, a second end, an outer surface, and a passage extending between the first end and the second end; and a receptacle extending through the outer surface of the tubular member for receiving a shaped charge;

wherein the tubular member comprises a reduced diameter section, and a first expanded diameter section disposed at the first end of the tubular member, the first expanded diameter section comprising a cylindrical outer surface having a greater diameter than the reduced diameter section, and wherein the interface between the reduced diameter section and the first expanded diameter section is jointless;

wherein the tubular member comprises a second expanded diameter section disposed at the second end thereof, the second expanded diameter section comprising a cylindrical outer surface having a greater diameter than the diameter of the reduced diameter section, and wherein the interface between the reduced diameter section and the second expanded diameter section is jointless.

2. The perforating tool of claim 1, wherein the reduced diameter section and the first expanded diameter section of the tubular member are monolithically formed.

3. The perforating tool of claim 1, wherein the first expanded diameter section comprises a key extending radially from the outer surface of the charge tube, and wherein the key is configured to be received within a groove of the outer housing to restrict relative rotation between the charge tube and the outer housing.

4. The perforating tool of claim 1, further comprising a stress riser extending through the charge tube.

5. The perforating tool of claim 4, wherein the stress riser comprises a perforation extending radially through the outer surface of the charge tube.

6. The perforating tool of claim 4, wherein the stress riser is configured to shear the receptacle extending through the outer surface of the tubular member.

7. The perforating tool of claim 1, wherein the first expanded diameter section and the second expanded diameter expansion are configured to radially centralize the charge tube within a throughbore of an outer housing.

8. The perforating tool of claim 1, wherein the outer housing comprises an indentation extending into the outer surface of the outer housing, and wherein the indentation is circumferentially aligned with the receptacle of the tubular member.

* * * * *